US005730469A

United States Patent [19]

Heimerdinger et al.

[11] Patent Number: 5,730,469

[45] Date of Patent: Mar. 24, 1998

[54] UNITARY SHIPPING AND PACKING LIST LABEL

[75] Inventors: Jeffrey P. Heimerdinger, Naperville; Michael J. Marchetti, Glen Ellyn, both of Ill.

[73] Assignee: Office Electronics, Inc., Itasca, Ill.

[21] Appl. No.: 693,975

[22] Filed: Aug. 8, 1996

[51] Int. Cl.[6] ..... G09F 3/00

[52] U.S. Cl. ..... 283/81; 283/79; 283/80

[58] Field of Search ..... 283/79–81, 62, 283/100, 101, 102, 105, 106; 40/310, 312, 630, 638; 428/43; D20/22

[56] References Cited

U.S. PATENT DOCUMENTS

| | | | |
|---|---|---|---|
| 3,994,089 | 11/1976 | Schwartz | 40/310 |
| 4,551,373 | 11/1985 | Conlon | 40/638 |
| 4,708,368 | 11/1987 | Instance | 283/81 |
| 4,744,591 | 5/1988 | Instance | 283/81 |
| 4,821,439 | 4/1989 | Wilck | 40/638 |
| 4,930,234 | 6/1990 | Schmidt | 40/638 |
| 5,071,167 | 12/1991 | O'Brien | 283/79 |
| 5,263,743 | 11/1993 | Jones | 283/81 |
| 5,340,158 | 8/1994 | Bartl | 283/81 |
| 5,484,170 | 1/1996 | Hatfield, Jr. | 283/79 |
| 5,509,694 | 4/1996 | Laurash et al. | 283/81 |

FOREIGN PATENT DOCUMENTS

| | | | |
|---|---|---|---|
| 535843 | 4/1993 | European Pat. Off. | 40/638 |

*Primary Examiner*—Daniel W. Howell
*Assistant Examiner*—Gregory Andoll
*Attorney, Agent, or Firm*—Young & Basile, P.C.

[57] ABSTRACT

A combination shipping and packing list label includes a face stock having a front face and a back face. The front face has an exposed, printable, generally planar surface. The printable surface is divided into a first printable are a and a second printable area separated from one another by a common edge along one side thereof. The face stock has a border area substantially surrounding at least three sides of the first printable area. An adhesive layer is disposed on at least a portion of the back face of the face stock for allowing the face stock to be adhesively applied to any desired supporting surface. A backing layer includes a carrier strip with a non-stick surface. The backing layer removably covers the adhesive layer connected to the back face of the face stock. The face stock is removable from a portion of the backing layer so that a first section of the backing layer covering the border area is left behind as a waste portion of the carrier strip to expose the adhesive layer for attaching the combination label to the supporting surface. A removable portion of the backing layer remains attached to the first printable area and second printable area of the combination label during folding and attachment to the supporting surface.

16 Claims, 3 Drawing Sheets

UNITARY SHIPPING AND PACKING LIST LABEL

FIELD OF THE INVENTION

The invention relates to shipping and packing slip labels for attachment to articles for shipment purposes and, more particularly, to a unitary shipping and packing list label for an article to be shipped.

BACKGROUND OF THE INVENTION

In the past, it has been the standard practice to employ a separate and distinct shipping label to carry the shipping address for packages to be shipped through private couriers or through the mail, and a separate and distinct packing list that can be inserted in the interior of the package to be shipped, or can be fastened by a self-adhesive layer connected to the back of a see-through pouch that carries the packing list when attached to the package or container to be shipped. If the packing list is shipped inside the container or package, it has the disadvantage that if it is desired to know detailed information regarding the contents of the package, the container must be opened. It has also been known for convenience to employ a transparent-front, adhesive-backed, packing slip container, where the container has a clear front plastic panel attached at its periphery to a backing piece of paper or light cardboard. The other side of the backing has adhesive covered with a releasible protective covering. A slit formed through the backing, adhesive and protective covering allows a folded packing slip to be inserted into the hollow space between the front panel and the backing. The shipping address for the container can be typed in a pre-established location of the packing slip so that when the packing slip is folded in a pre-established manner, the address will be visible through the clear plastic front panel.

SUMMARY OF THE INVENTION

It is desirable in the present invention to provide a unitary combined shipping and packing list label that can be printed completely by computer-driven machinery and attached to a package or container in a manner sufficient to prevent the combined label from being inadvertently torn off from the package or container. The combination shipping and packing list label according to the present invention includes a first layer or face stock having a front face and a back face. The front face has an exposed, printable, generally planar surface. The printable surface is divided into a first printable area and a second printable area separated from one another by a common edge along one side thereof. The first layer further includes a border area substantially surrounding at least three sides of the first printable area. The first layer generally has an overall T-shaped configuration. An adhesive layer is disposed on at least a portion of the back face of the first layer, and preferably over the entire back face of the first layer or face stock for allowing the first layer to be adhesively applied to any desired supporting surface, such as an exterior surface of a package or container. A backing layer, such as a carrier strip having a non-stick coating, such as a silicon layer, applied thereto removably covers the adhesive layer connected to the first layer. A portion of the backing layer is removable from the remaining portion, so that a first generally U-shaped section of the backing layer covering the border area of adjacent labels remains attached to one another to define a waste portion of the carrier strip after removal of the face stock and removable backing layer portion attached to the first and second printable areas of the combination shipping and packing list label in preparation for adhering the combination label to an exterior surface of the package or container.

The combination shipping and packing list label can be pre-printed with any desired indicia common to the labels, such as the shipper's return address or instructions for using or removing the combination shipping and packing list label. The various layers of the combination shipping and packing list label can be formed with predetermined perforations or serrations. The perforations can be die cut through the various layers of the combination shipping and packing list label from blank continuous label stock or web. The blank continuous label stock typically includes four parts: namely, the face stock; an adhesive layer; a silicon layer; and a carrier.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 5:
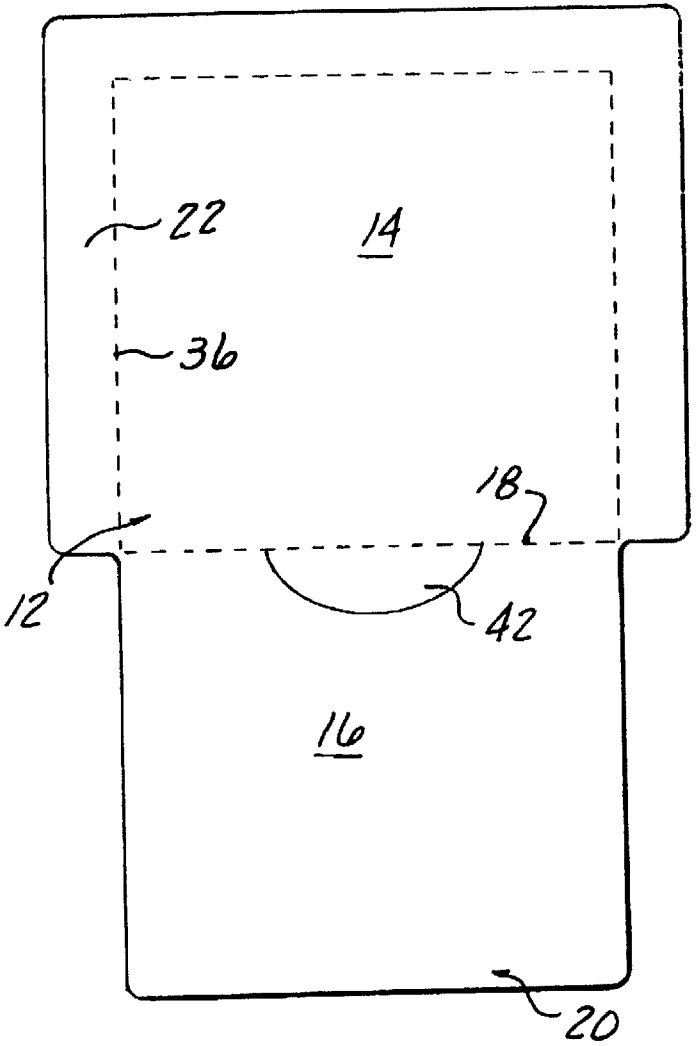
FIG. 5 is a first face stock or front layer of the combination shipping and packing list label according to the present invention.

A combination shipping and packing list label 10 according to the present invention includes a face stock or first layer as best seen in FIG. 5. The first or front layer includes a front face and a back face. The front face has an exposed, printable, generally planar surface 12. The printable surface 12 is divided into a first printable area 14 and a second printable area 16 separated from one another by a common edge 18 along one side thereof. The first layer 20 further includes a border area 22 substantially surrounding at least three sides of the first printable area 14.

Figure 1:
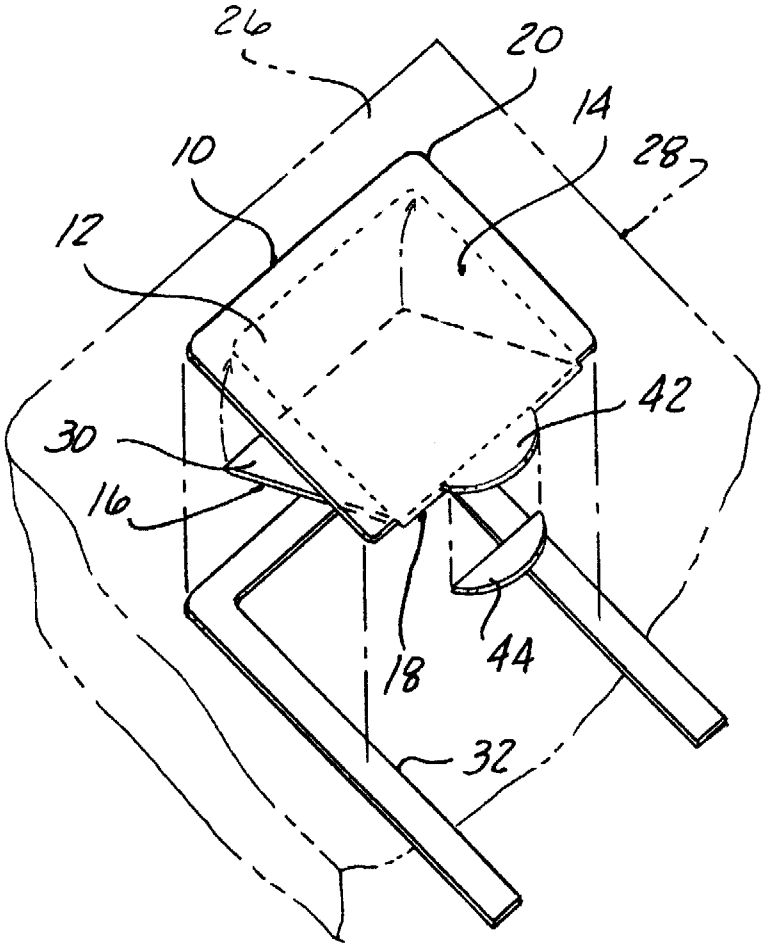
FIG. 1 is an exploded perspective view of a combination shipping and packing list label according to the present invention being folded and with portions of a backing layer removed for application to an exterior surface of a package or container.

The combination shipping and packing list label 10 also includes an adhesive layer 24 disposed on at least a portion of the back face of the first layer 20 for allowing the first layer 20 to be adhesively applied to any desired supporting surface 26, such as an external surface of a package or container 28 as illustrated in FIG. 1. The appropriate face stock and adhesive is selected as appropriate for the desired application based on the conditions that are expected to occur during use of the label.

Figure 4:
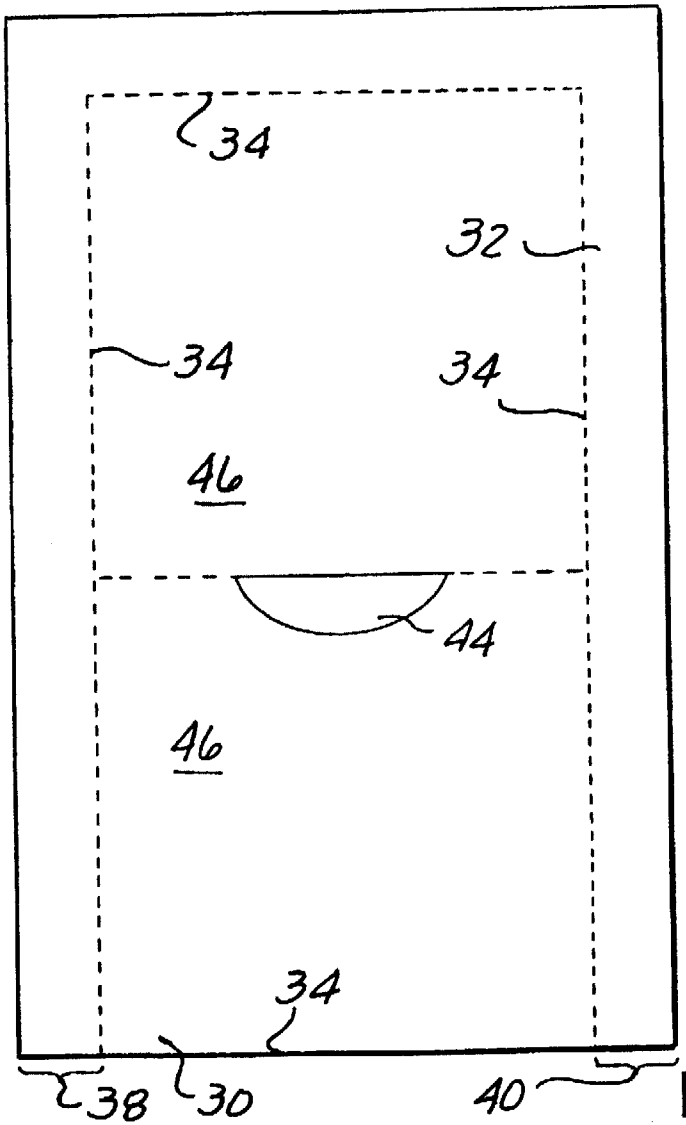
FIG. 4 is a plan view of a backing layer or carrier with a non-stick surface of the combination shipping and packing list label according to the present invention.

A carrier with non-stick surface or backing layer 30 is also provided for the combination shipping and packing list label 10 as best seen in FIG. 4. The backing layer 30 removably covers the adhesive layer 24 connected to the first layer 20. The face stock and a portion of the backing layer is preferably removable from a section of the carrier, so that a first section 32 of the backing layer 30 covering the border area 22 of the first layer 20 is left behind as a waste portion of the carrier after the combination label has been removed from the carrier. Preferably, the backing layer 30 has a backing perforation or serration 34 extending along a periphery of the printable surface 12, such as four sides of the rectangular configuration illustrated, so that the backing perforation 34 extends through the backing layer 30 to define a removable backing section 46 that remains attached to the printable surface 12 as the combination label is removed from the carrier strip, including the first section 32 covering the border area 22. Preferably, a portion of the backing perforation 34 is a relatively weak connection, such as a perforation formed using approximately four teeth per inch, between the border area 32 and the removable backing section 46 of the backing layer 30. Preferably, relatively stronger backing perforations 38 and 40 are formed using approximately eight to ten teeth per inch to connect the border area 32 of the backing layer 30 to one another in a continuous strip of carrier material and defining a waste portion of the carrier after removal of the combination label, as described in greater detail below. The backing layer 30 can also include a precut tab backing 44 to permit independent removal of the tab backing 44, so that the second printable area 16 can be held securely beneath the first printable area 14 when the backing layer portion of the first section 32 is removed from the border area 22 to secure the first layer 12 to any desired supporting surface 26.

Figure 6:
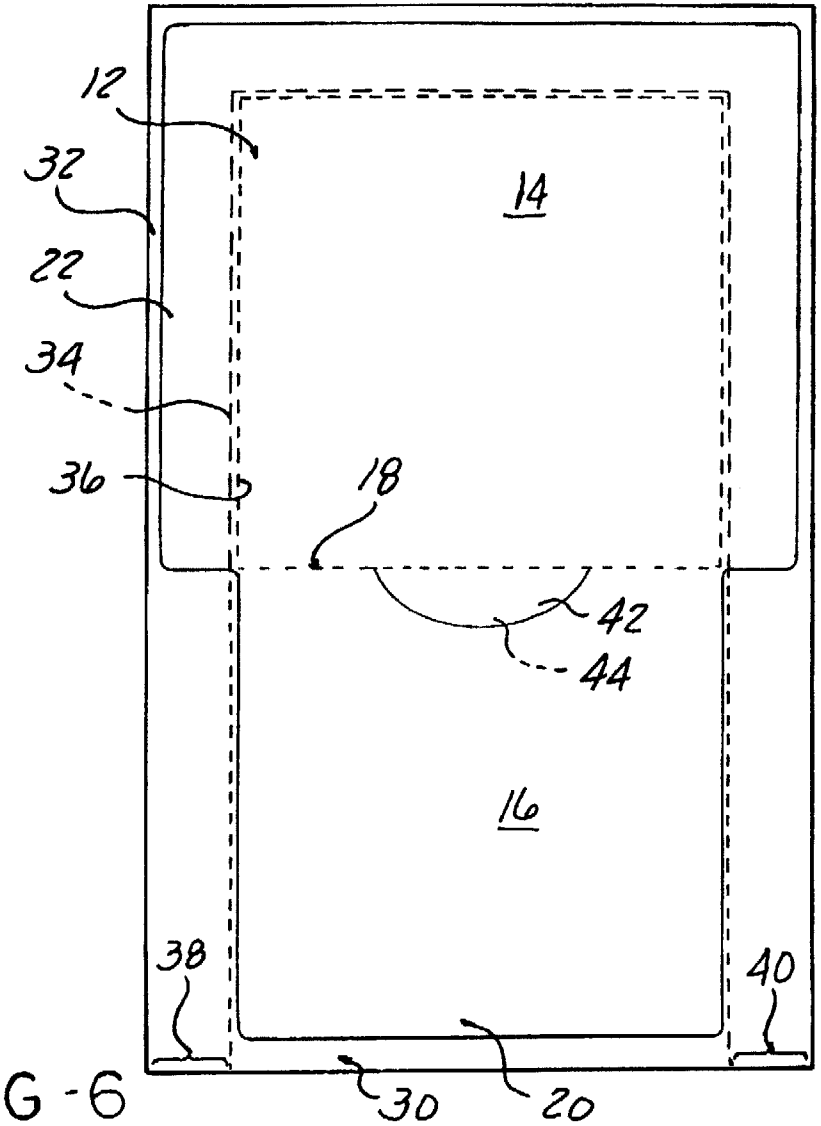
FIG. 6 is a plan view of the face stock superimposed over the carrier in the desired orientation according to the present invention.

The front layer 12 preferably has a label perforation or serration 36 extending through the front layer 12 defining the first printable area 14, the second printable area 16, the border area 22 and a tab portion 42. The label perforation 36, as best seen in FIG. 6 is spaced inwardly with respect to the backing perforation 34 when the border area 22 of the front layer 20 is removably connected to the first section 32 of the backing layer 30. Preferably, the label perforation 36 extends along the common edge 18 between the first printable area 14 and the second printable area 16. The common edge label perforation preferably extends through the backing layer 30 to define a folding edge between the first printable area 14 and the second printable area 16, so that the second printable area 16 can be folded beneath the first printable area 14. When folded in this manner, the second printable area is substantially enclosable by the overlaying border area 22 of the first printable area 14 when the first section 32 of the backing layer 30 is removed for connecting the combination shipping and packing list label 10 to the supporting surface 26. The first printable area 14 can include the outwardly extending tab portion 42 along the common edge 18. The outwardly extending tab portion 42 extends along at least a portion of the periphery of the first printable area 14. Preferably, the common edge label perforation acts as a tear away edge to allow the tab 42 to remain on the package with the border area 22 when the first and second printable areas, 14 and 16 respectively, of the combination shipping and packing list are removed from the package after shipping. Preferably, the first printable area 14 defines a shipping label portion for receiving shipping information printed thereon, and the second printable area 16 defines a packing list label for receiving packing list information printed thereon.

Figure 2:
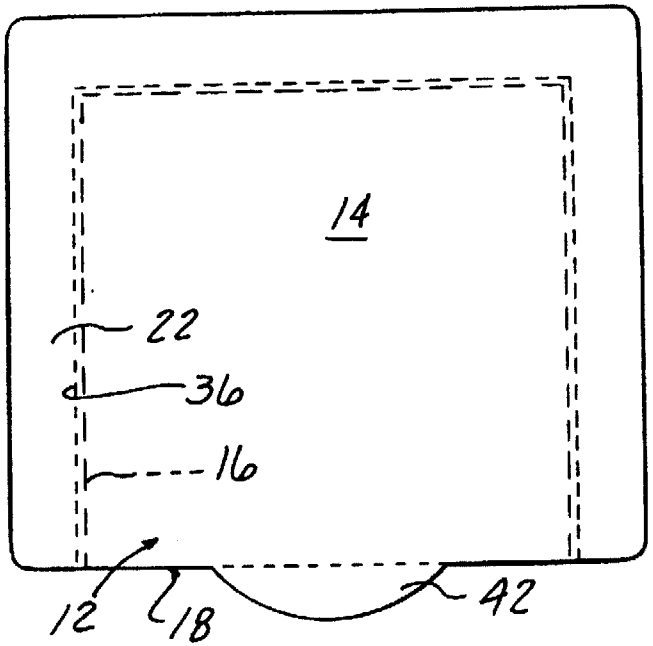
FIG. 2 is a plan view of a folded combination shipping and packing list label according to the present invention after removal from a carrier strip or web.
Figure 3:
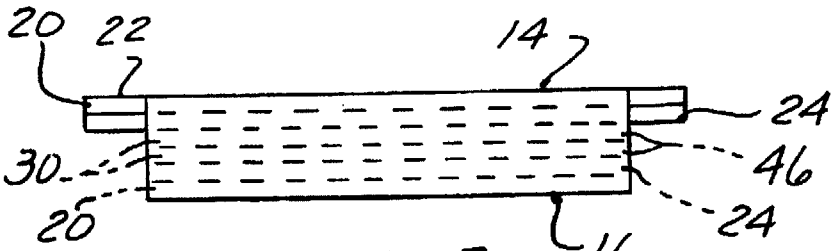
FIG. 3 is a front elevational view of the folded combination shipping and packing list label with the layers greatly exaggerated for purposes of illustration.

The combination shipping and packing list label 10 according to the present invention therefore includes a single, multi-layer sheet of material having a front face and a back face. The front face is formed at least in part of a first material layer or face stock 20 having a printable surface thereon. The printable surface 12 includes a peripheral edge and a fold line 18 extending between opposite portions of the peripheral edge. The fold line 18 defines a first printable area 14 and a second printable area 16, wherein the second printable area is foldable beneath the first printable area as illustrated in FIGS. 1–3. The first material layer or front face can further include a border area 22 extending along at least a portion of the peripheral edge of the first printable area 14 and extending outwardly therefrom to substantially encompass the second printable area when folded under the first printable area as best seen in FIGS. 2 and 3. Preferably, the entire back face of the face stock has an adhesive layer 24 connected thereto for adhesively connecting the face stock 20 of the front face to any desired supporting surface 26 of a package or container 28. The back face of the single multi-layer sheet of material is formed of a carrier strip with a non-stick coating or backing layer 30 removably covering the adhesive layer 24.

Figure 7:
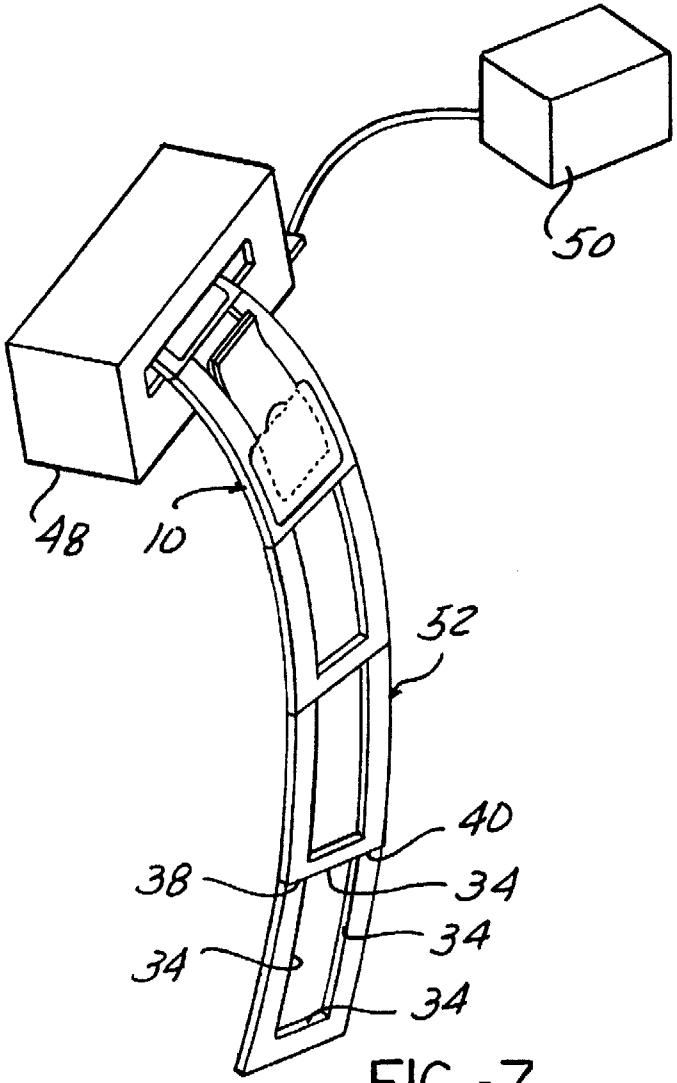
FIG. 7 is a perspective view of electronic data processing equipment and a printer for applying printed indicia to the face stock of the combination shipping and packing list label according to the present invention and illustrating a combination label partially removed from a waste portion of the carrier after printing.

Referring now to FIG. 7, in use a continuous web of the combination shipping and packing list label 10 according to the present invention is first imprinted with the desired information by an appropriate printer 48, such as a direct thermal printer or thermal transfer printer. The information may be supplied by any appropriate data processing equipment 50. After being imprinted with the appropriate information, the combination label is removed from the first section 32 of the backing layer 30, or waste portion 52 of the carrier strip, and the tab backing 44 is removed from the tab portion 42 as best seen in FIG. 1. The second printable area 16 or packing list area is then folded under the first printable area 14 or shipping label area as best seen in FIGS. 1 and 3. The removable backing portion 46 of the carrier strip is still attached to the first printable area 14 and the second printable area 16. The border area 22 and the tab 42 of the combination label are then adhesively secured to the supporting surface 26, such as the external surface of a package or container 28 as illustrated in FIG. 1. The present invention allows for the production of a combination shipping and packing list label without the need for an expensive pattern adhesive application to the face stock as has been the practice in the past.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A combination shipping and packing list label comprising:

a first layer having a front face and a back face, the front face having an exposed printable generally planar surface, the printable surface divided into a first printable area and a second printable area separated from one another by a common edge along one side thereof to define a bi-fold label, the second printable area having smaller dimensions and area than the first printable area such that when folded said first printable area completely overlies said second printable area, the first layer further having a border area substantially surrounding at least three sides of the first printable area;

an adhesive layer completely covering the back face of the first layer for allowing the first layer to be adhesively applied to any desired supporting surface; and a backing layer defined by a continuous strip of carrier material, said backing layer removably covering the adhesive layer connected to the first layer, wherein the backing layer is removable in sections such that a first section of the backing layer covering the border area is removable independently of other sections, said first section defining a waste portion of said carrier strip after removal of said bi-fold label.

2. The combination shipping and packing list label of claim 1 further comprising:

the backing layer having a backing serration therethrough defining the first section.

3. The combination shipping and packing list label of claim 1 further comprising:

the first layer having a label serration therethrough defining the first printable area, the second printable area and the border area.

4. The combination shipping and packing list label of claim 3 further comprising:

the backing layer having a backing serration therethrough defining the first section; and the label serration spaced inwardly toward a center of the label with respect to the backing serration when the first layer is removably connected to the backing layer.

5. The combination shipping and packing list label of claim 3 further comprising:

the label serration extending through the backing layer along the common edge to define a folding edge between the first printable area and the second printable area, such that the second printable area is foldable beneath the first printable area and the second printable area is substantially enclosable by the overlaying border area of the first printable area when the first section of backing layer is removed therefrom for connection of the bi-fold label to the supporting surface.

6. The combination shipping and packing list label of claim 5 further comprising:

the label serration along the common edge including an outwardly extending tab portion extending along at least a portion of the periphery of the first printable area.

7. The combination shipping and packing list label of claim 6 further comprising:

the backing layer including a precut tab backing under the tab portion to permit independent removal of the tab backing, such that the second printable area can be held securely beneath the first printable area when the backing layer portions are removed from the border area and the tab portion to secure the first layer to any desired supporting surface.

8. The combination shipping and packing list label of claim 1 further comprising:

the first printable area defining a shipping label portion for receiving shipping information printed thereon.

9. The combination shipping and packing list label of claim 1 further comprising:

the second printable area defining a packing list label for receiving packing list information printed thereon.

10. The combination shipping and packing list label of claim 1 further comprising:

said first layer having a first perforation extending around an entire periphery of said first printable area allowing said first printable area to be separable from said second printable area and from said border area along said first perforation; and said backing layer having a second perforation extending around said entire periphery of said first printable area and along two opposing sides edges of said second printable area allowing a first section of said backing layer covering said border area to be separable from a second section of the backing layer covering the first and second printable areas, said backing layer further having a third perforation extending between opposing peripheral edges of said backing layer and in communication with terminal ends of said second perforation opposite from said fold line, said third perforation including a first portion with weaker tear strength characteristics than a second portion, said first portion extending along a side of said second printable area opposite from said fold line and between said terminal ends of said second perforation allowing removal of said bi-fold label from said first section of said backing layer to expose said adhesive layer along said border area of said first layer while maintaining engagement of said second section of said backing layer with said first and second printable areas after separation from said first section, and while leaving said first section attached to said backing layer along said second portion of said third perforation to define said waste portion of said backing layer.

11. A combination shipping and packing list label comprising:

a continuous, elongate, single multi-layer sheet of material having a front face and a back face, the front face formed at least in part of spaced, repetitive, identical, discrete areas of a first material having a printable surface thereon, the printable surface having a peripheral edge and a fold line extending between opposite portions of the peripheral edge to define a bi-fold label, the fold line defining a first printable area and a second printable area, wherein the second printable area has dimensions and an overall area less than the first printable area and is foldable beneath the first printable area such that said first printable area completely overlies said second printable area, the front face further including a border area extending along at least a portion of the peripheral edge of the first printable area and extending outwardly therefrom to substantially encompass the second printable area when folded under the first printable area, the border area having a rear face and an adhesive layer connected to the rear face for adhesively connecting the first material of the front face to any desired supporting surface, the back face formed of a backing layer removably covering the adhesive layer, said front face having a first perforation extending around an entire periphery of said first printable area allowing said first printable area to be separable from said second printable area and from said border area along said first perforation, and said back face having a second perforation extending around said entire periphery of said first printable area and along two opposing sides edges of said second printable area, said back face further having a third perforation extending between opposing peripheral edges of said back face and in communication with terminal ends of said second perforation opposite from said fold line, said third perforation including a first portion with weaker tear strength characteristics than a second portion, said first portion extending along a side of said second printable area opposite from said fold line and between said terminal ends of said second perforation allowing removal of said bi-fold label from said first section of said back face to expose said adhesive layer along said border area of said front face while maintaining engagement of said second section of said back face with said first and second printable areas after separation from said first section, and while leaving said first section attached to said backing layer along said second portion of said third perforation to define a continuous, elongate, waste portion of said sheet.

12. The combination shipping and packing list label of claim 11 further comprising:

the first perforation spaced inwardly toward a center of the label with respect to the second perforation when the first material is removably connected to the backing layer.

13. The combination shipping and packing list label of claim 11 further comprising:

the first perforation including an outwardly extending tab portion along at least a portion thereof.

14. The combination shipping and packing list label of claim 13 further comprising:

the backing layer including a precut tab backing under the tab portion to permit independent removal of the tab backing, such that the second printable area can be held securely beneath the first printable area when the backing layer portions are removed from the border area and the tab portion of the first material to secure the bi-fold label to any desired supporting surface.

15. The combination shipping and packing list label of claim 11 further comprising:

the first printable area defining a shipping label portion for receiving shipping information printed thereon; and the second printable area defining a packing list label for receiving packing list information printed thereon.

16. A combination shipping and packing list label comprising:

a single multi-layer sheet of material having a front face and a back face, the front face formed at least in part of a first material having a printable surface thereon, the printable surface having a peripheral edge and a fold line extending between opposite portions of the peripheral edge to define a bi-fold label, the fold line defining a first printable area and a second printable area, the first printable area defining a shipping label portion for receiving shipping information printed thereon, the second printable area defining a packing list label for receiving packing list information printed thereon, the front face further including a border area extending along at least a portion of the peripheral edge of the first printable area and extending outwardly therefrom to substantially encompass the second printable area when folded under the first printable area, the border area having a rear face and an adhesive layer connected to the rear face for adhesively connecting the first material of the front face to any desired supporting surface, the back face formed of a backing layer removably covering the adhesive layer, the backing layer having a backing layer serration therethrough defining a first section removably covering the adhesive layer on the border area of the front face, the front face having a label serration therethrough defining the first printable area, the second printable area and the border area, the label serration spaced inwardly toward a center of the label with respect to the backing layer serration when the first material is removably connected to the backing layer, the label serration extending through the backing layer along the foldable edge, such that the second printable area is foldable beneath the first printable area and selectively separable therefrom, the foldable edge label serration including an outwardly extending tab portion along at least a portion thereof, the backing layer including a precut tab backing under the tab portion to permit independent removal of the tab backing, such that the second printable area can be held securely beneath the first printable area and substantially enclosed by the overlaying border area of the first printable layer when the backing layer portions are removed from the border area and the tab portion of the first material to secure the bi-fold label to any desired supporting surface.

* * * * *